US011652268B2

(12) United States Patent
Duffy et al.

(10) Patent No.: US 11,652,268 B2
(45) Date of Patent: May 16, 2023

(54) ANTENNA ROTATOR

(71) Applicant: PDS Electronics, Inc., Tallmadge, OH (US)

(72) Inventors: Tim Duffy, West Middlesex, PA (US); Cory Gibson, Atwater, OH (US); Christopher R. Cummings, Newton Falls, OH (US)

(73) Assignee: PDS Electronics, Inc., Tallmadge, OH (US)

( * ) Notice: Subject to any disclaimer, the term of this patent is extended or adjusted under 35 U.S.C. 154(b) by 332 days.

(21) Appl. No.: 16/719,568

(22) Filed: Dec. 18, 2019

(65) Prior Publication Data

US 2021/0194123 A1 Jun. 24, 2021

(51) Int. Cl.
*H01Q 3/02* (2006.01)
*H01Q 1/12* (2006.01)

(52) U.S. Cl.
CPC ..... *H01Q 1/125* (2013.01); *H01Q 3/02* (2013.01)

(58) Field of Classification Search
CPC .... H01Q 1/125; H01Q 1/1228; H01Q 1/1242; H01Q 1/1257; H01Q 1/246; H01Q 3/005; H01Q 3/02; H01Q 3/04; H01Q 3/06
See application file for complete search history.

(56) References Cited

U.S. PATENT DOCUMENTS

2015/0144758 A1* 5/2015 Kolokotronis ..... H01Q 1/1228 248/282.1

* cited by examiner

*Primary Examiner* — Robert Karacsony
(74) *Attorney, Agent, or Firm* — Timothy A. Hodgkiss; Buckingham Doolittle Burroughs

(57) ABSTRACT

An antenna rotator includes a housing having an access port disposed therethrough. Positioned within the housing and proximate to the access port is an interface connector. The interface connector provided by the housing is configured to be removably attached to a module connector provided by a detection module, which may include a sensor for detecting a position of an encoder that is rotated by a motor drive within the housing. As a result, the detection module, which is highly susceptible to electrical damage from lightning, can be conveniently accessed and replaced.

12 Claims, 6 Drawing Sheets

ANTENNA ROTATOR

TECHNICAL FIELD

The various embodiments disclosed herein relate to antenna rotators. More particularly, the various embodiments disclosed herein relate to antenna rotators having a motor drive with a selectively movable shaft to move an antenna. In particular, the various embodiments disclosed herein relate to antenna rotators having a removable position detection module to monitor a position of the selectively movable shaft, whereby the detection module is user-friendly to access and convenient to remove and replace.

BACKGROUND

Given the nature of antennas, including those utilized in the field of HAM radio (i.e. amateur radio), they are required to be mounted in an elevated manner so that the signals the antenna is intended to receive are not blocked by obstructions, such as buildings, trees, walls, and the like. Furthermore, antennas generally require that they be periodically rotated so that the antenna is oriented in a direction that optimizes the reception of the signal that is intended to be received. In order to conveniently rotate the antenna at its elevated position, an antenna rotator system is commonly used.

The antenna rotator system includes an antenna rotator or drive unit, which includes an electromechanical motor drive that is carried within a weather-resistant housing, and a remote user control unit that communicates with the rotator system to rotate the antenna in a direction determined by the end user. The antenna may be attached to a shaft provided by the electro-mechanical motor drive of the rotator system directly or through an elongated mast or mounting pole to which the antenna is mounted. Because the antenna and the antenna mounting poles are typically formed of metallic materials, and due to of the elevated position of the antenna, the rotator system is susceptible to being hit directly or indirectly by lightning strikes. Accordingly, the electronic components of the motor drive are exposed to damaging levels of electrical voltage and electrical currents. As a result, these electronic components contained within the housing of the antenna rotator are highly susceptible to failure and require frequent replacement. One particular electronic component that is especially susceptible to lightning damage and resultant failure is an antenna position encoder that is used to monitor the position of the antenna as it is rotated by the motor drive in the rotator housing.

Unfortunately, such replacement is difficult, cumbersome and time consuming given the often high, elevated position at which the antenna is mounted. As such, the antenna rotator must be removed from its elevated position, which entails the danger associated with working at heights, and then taken to a remote repair location. However, even if the rotator is successfully removed, it is exceedingly difficult to gain access to the electrical components therewithin due to the weather-proof design of the housing to conduct a repair. As a result, the antenna is taken out of service for an extended period of time to complete the repair, which is undesirable. In addition, it is extremely costly to remove the antenna rotator and have the damaged electrical components, which are often integrated on a single printed circuit board (PCB) repaired. In fact, in many instances, given the integrated PCB design of the electronics of the antenna rotator, the PCB cannot be repaired, particularly the position encoder electronics, and as a result a full, costly replacement of the entire PCB is required.

Therefore, it is desirable to provide a housing for an antenna rotator that includes one or more removable electronic components, such as a removable position detection module used to monitor an output shaft of a motor drive used to move an antenna, which is user-friendly to access and convenient to remove and replace. Furthermore, it is desirable to provide a housing for an antenna rotator that includes a removable position detection module that can be removed and replaced at the housing without removing the housing from its mounted location.

SUMMARY OF THE INVENTION

It is a first aspect of one or more embodiments disclosed herein to provide an antenna rotator including a housing having an access port; a motor drive assembly carried in the housing, the motor drive assembly adapted to be coupled to an antenna; an interface connector carried in the housing and positioned proximate to the access port, the interface connector coupled to a power supply line and a position detection line; and a detection module proximate to the access port and removably attached to the interface connector so as to communicate with the power supply line and the antenna position detection line, the detection module configured to detect a rotating position of a component of the motor drive assembly.

An antenna rotator including a housing having an access port; a motor drive assembly carried in the housing, the motor drive assembly adapted to be coupled to an antenna; an interface connector carried in the housing and positioned proximate to the access port, the interface connector in electrical communication with one or more of a power supply line and a communication line; and a module positioned proximate to the access port and removably attached to the interface connector so as to communicate with one or more of the power supply line and the communication line, the module including an electronic component to control the operation of the motor drive assembly.

BRIEF DESCRIPTION OF DRAWINGS

These and other features and advantages of the various embodiments disclosed herein will become better understood with regard to the following description, appended claims, and accompanying drawings, wherein:

DETAILED DESCRIPTION

Figure 1A:
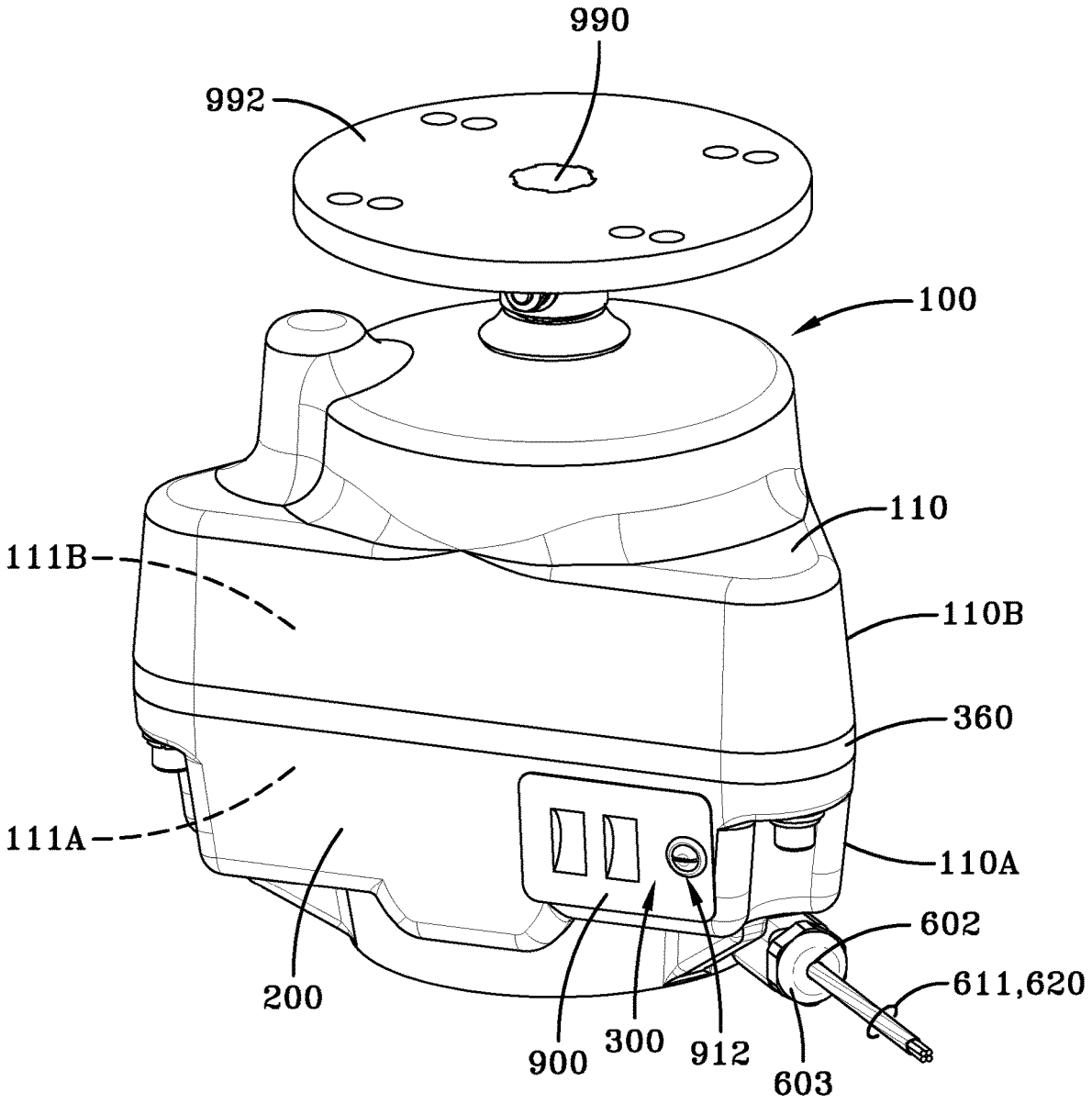
FIG. 1A is a perspective view of an antenna rotator in accordance with the concepts of the various embodiments disclosed herein.

An antenna rotator is generally referred to by numeral 100 as shown in FIGS. 1-2 of the drawings. In particular, the antenna rotator 100 includes a housing 110 formed of a plurality of housing sections, such as base section 110A and cap section 110B each having respective cavities 111A and 111B. Disposed through a wall 200 of the base section 110A is a module aperture or access port 250, which opens into the cavity 111A. The access port 250 allows the selective removal and attachment of a position detection module 300 that monitors an encoder 310 that is rotated by a motor drive 340 carried in the housing 110.

The housing sections 110A-B may be formed of any suitable material, such as metal or polymeric material for example. In addition, the housing sections 110A-B may be joined together by any suitable fastener, such as screws, rivets, adhesive, and the like. In some embodiments, the sections 110A and 110B may be formed so that they take on any suitable complementary shape that allows them to be attached together. For example, one or more of the first and second sections 110A-B may be formed to have generally triangular shapes, but is not required, as the sections 110A-B may have a rectilinear shape, a curvilinear shape, or a shape that is a combination thereof. Furthermore, when the housing 100 is assembled, the sections 110A and 110B may be separated from each other by a separating member 360, which will be discussed in detail below. However, in other embodiments, the separating member 360 may be fully confined within the housing so that it does not separate the sections 110A and 110B.

Figure 2A:
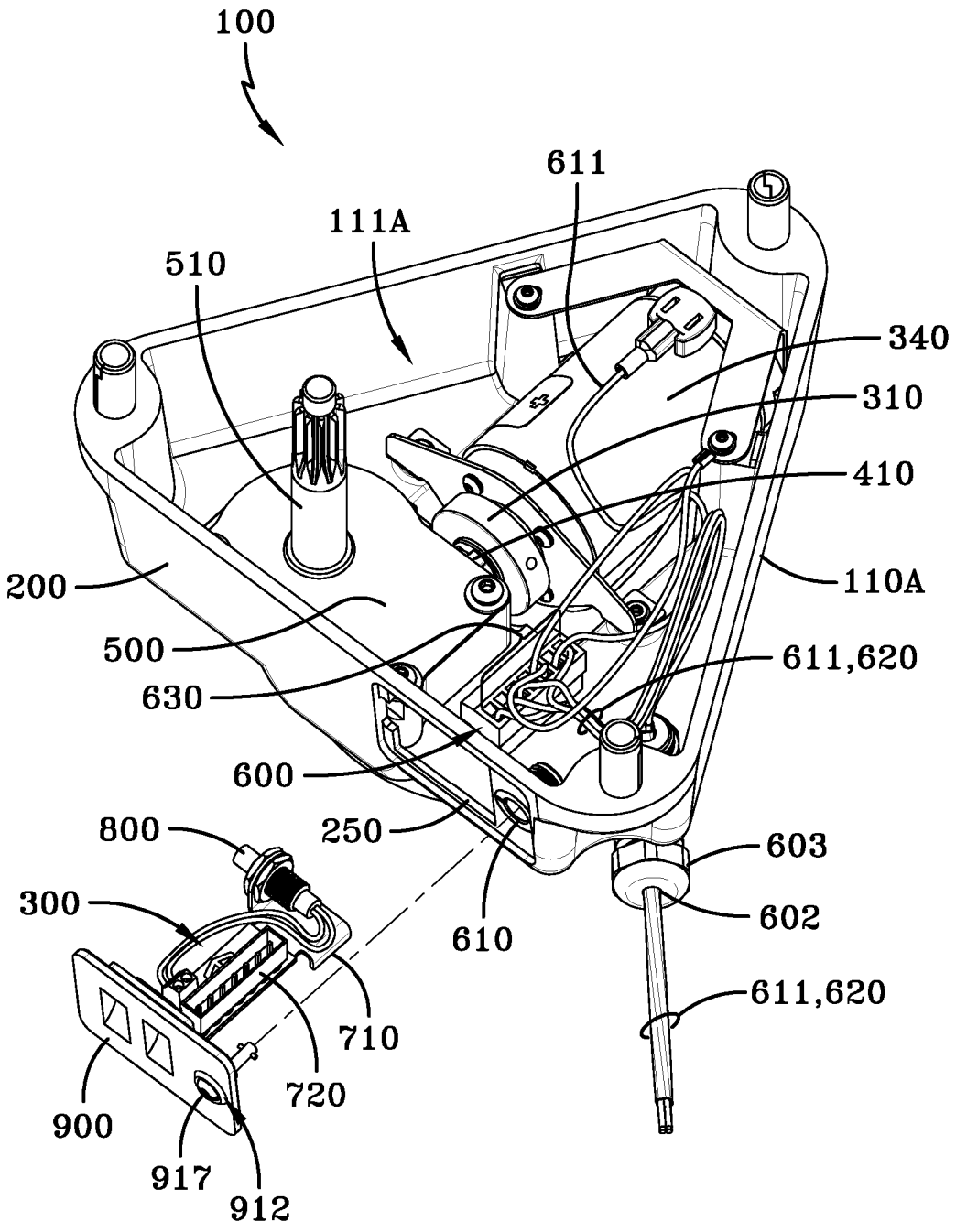
FIG. 2A is a perspective view of a base section of the antenna rotator housing having a detection module removed therefrom in accordance with the concepts of the various embodiments disclosed herein.
Figure 2B:
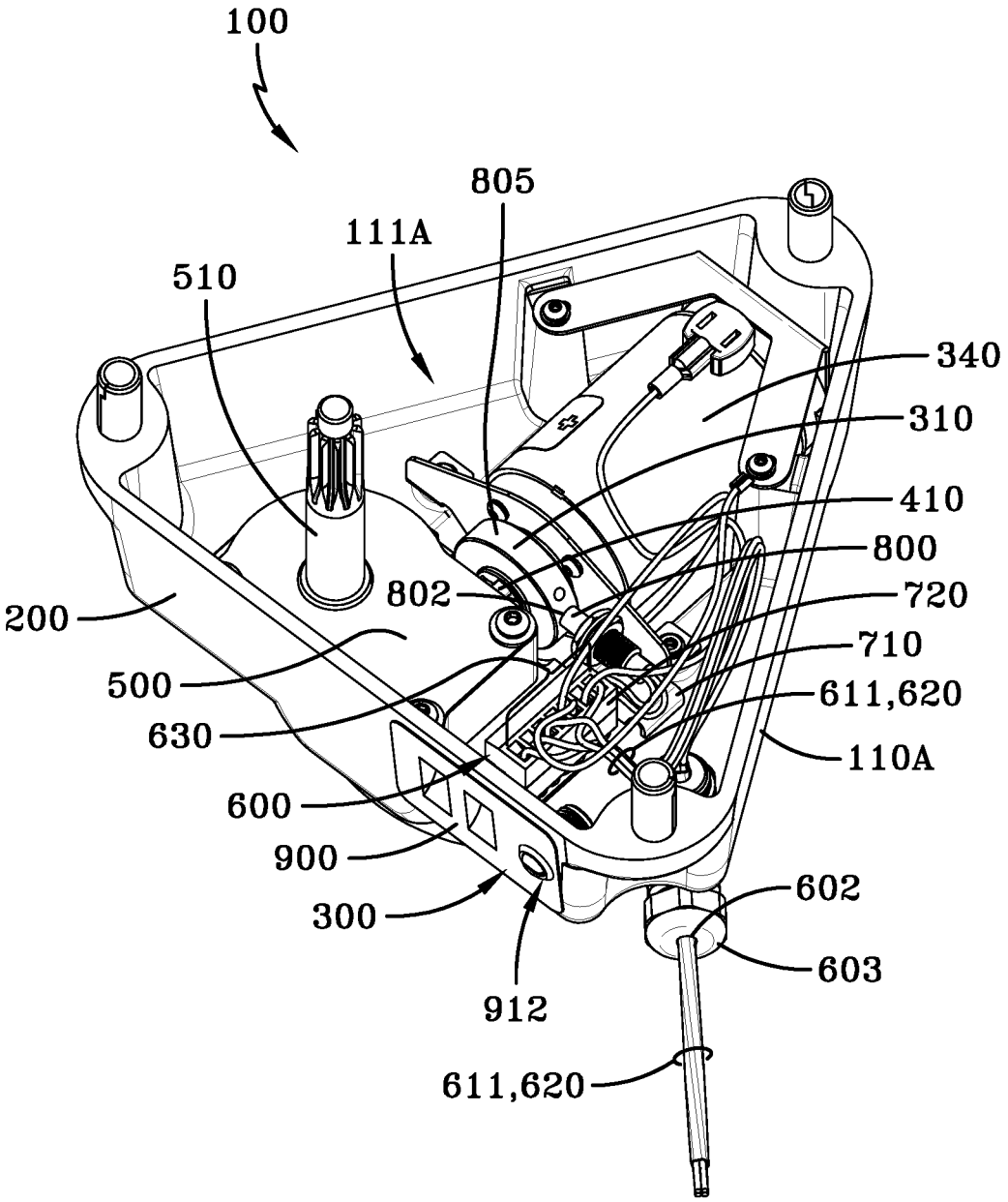
FIG. 2B is a perspective view of a base section of the antenna rotator housing having the detection module installed thereto in accordance with the concepts of the various embodiments disclosed herein.

The cavity 111A formed by the base section 110A of the rotator housing 110 carries several components, as shown in FIGS. 2A-B. In particular, the base section 110A includes the electric motor drive 340 mounted thereto, such as by suitable fasteners. The motor drive 340 includes a drive shaft 410 that is rotated by operation of the motor drive 340. It should be appreciated that the motor drive 340 may be an AC (alternating current) motor or a DC (direct current) motor. The motor drive 340 is coupled by an electrical line 611 to a suitable power source, such as an AC (alternating current) or DC (direct current) power source.

Attached to the drive shaft 410 of the motor drive 340 is the encoder 310. In some embodiments, the encoder 430 may include a disk or wheel that is mounted to the drive shaft 410, and rotatably carried by the drive shaft 410 as it is driven under the operation of the motor drive 340. In some embodiments, the encoder 310 may comprise a magnetic encoder, such as a magnetic encoder wheel or disk. However, the encoder 310 may comprise an optical encoder, which may be embodied as a wheel or disk. In still other embodiments, the encoder 430 may have any suitable detectable indicia. In addition, the encoder 310 may comprise any element in which a position of the drive shaft 410 can be determined through communication with the detection module 300 to be discussed. It should be appreciated that the encoder 310 shown in the FIGS. comprises a magnetic encoder disk.

A transmission 500 is also carried within the cavity 111A of the base section 110A and is in operative communication with the drive shaft 410 of the motor drive 340. The transmission 500 includes a transmission output shaft 510. The transmission 500 serves to alter the torque and rotational speed generated by the shaft 410 with a different rotational speed and torque that is supplied by the output shaft 510. It should be appreciated that in some embodiments, the transmission 500 may not be used.

An interface connector 600 is mounted within the cavity 111A formed by the base 110A. The interface connector 600 is coupled to various electrical and/or communication lines that are routed through the wall 200 of the housing 110 to a region that is external to the rotator 100. The interface connector 600 is mounted within the cavity 111A so that is it proximate to, and in some embodiments adjacent to, the module aperture 250 that is disposed through the wall 200 of the base housing 110A. In further embodiments, a lock aperture 610 is disposed through the wall of the base 110A. In some embodiments, the lock aperture 610 is positioned adjacent or proximate to the module aperture 250. In further embodiments, the electrical lines that are coupled to the interface connector 600 include one or more of a power supply line 611 and an antenna position monitor or detection line 620. In some embodiments, the interface connector 600 includes one or more terminals 630 to which the various electrical lines are connected, such as the power supply line 611 and the antenna position monitor line 620. It should be appreciated, that in some embodiments, seven terminals 630 are used; however, the interface connector 600 may include any number of terminals 630. In addition, the electrical lines 611 and 620 that are coupled to the interface connector 600 may be routed through a wire aperture (not shown) that is disposed through the wall 200 of the base 110A. This wire aperture is in communication with another aperture 602 that is provided in a grommet or compression fitting 603 that is secured in the wall 200 of the housing 100, such as by threaded fit for example. It should be appreciated that the free ends of the lines 611 and 620 may be respectfully attached to a suitable power source and a position controller device used to set a user defined position in which the antenna is to be rotated by the rotator 100 and/or to monitor a position of the antenna via the encoder 310 in a manner to be discussed.

Figure 3A:
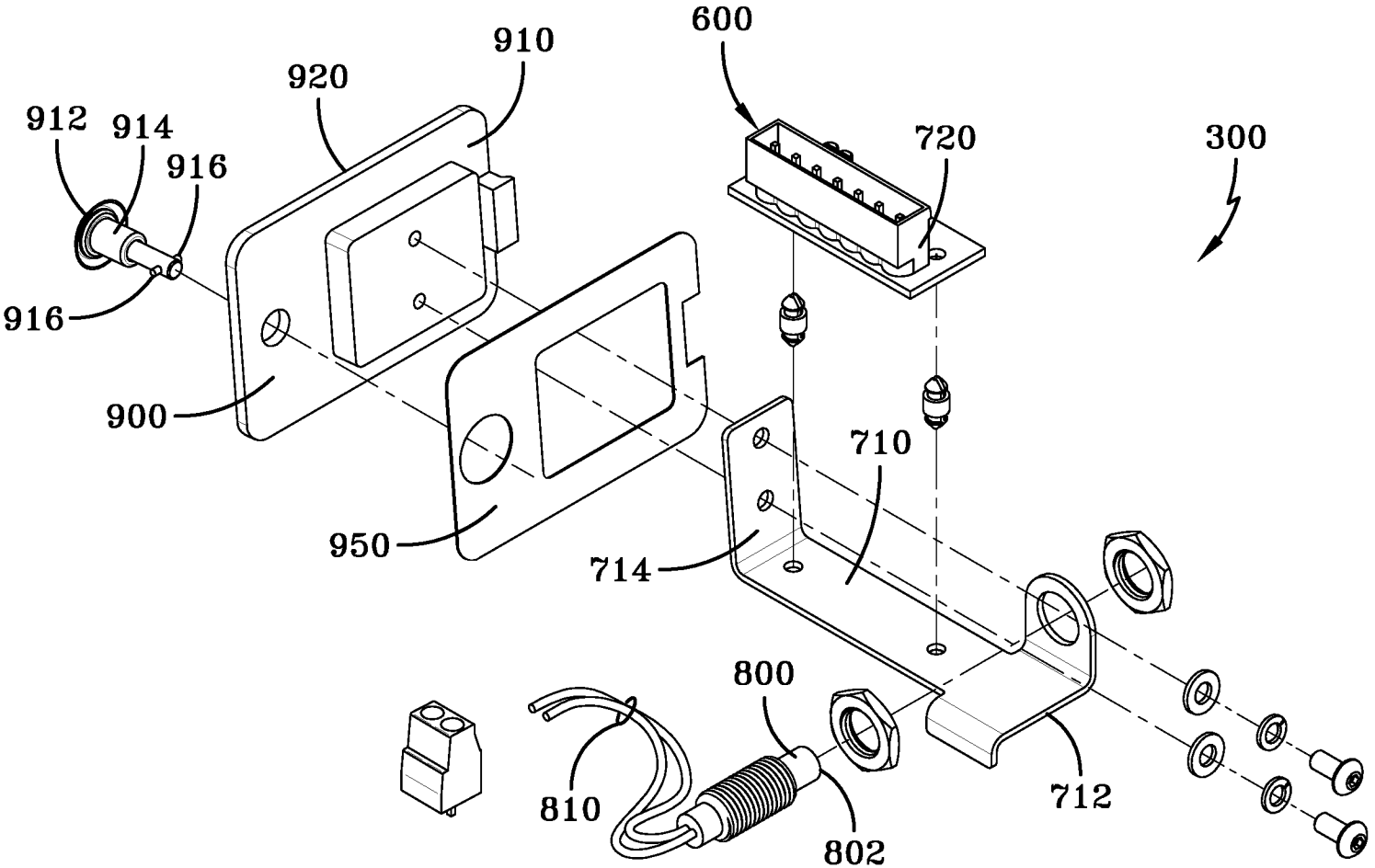
FIG. 3A is an exploded view of the detection module in accordance with the concepts of the various embodiments disclosed herein.
Figure 3B:
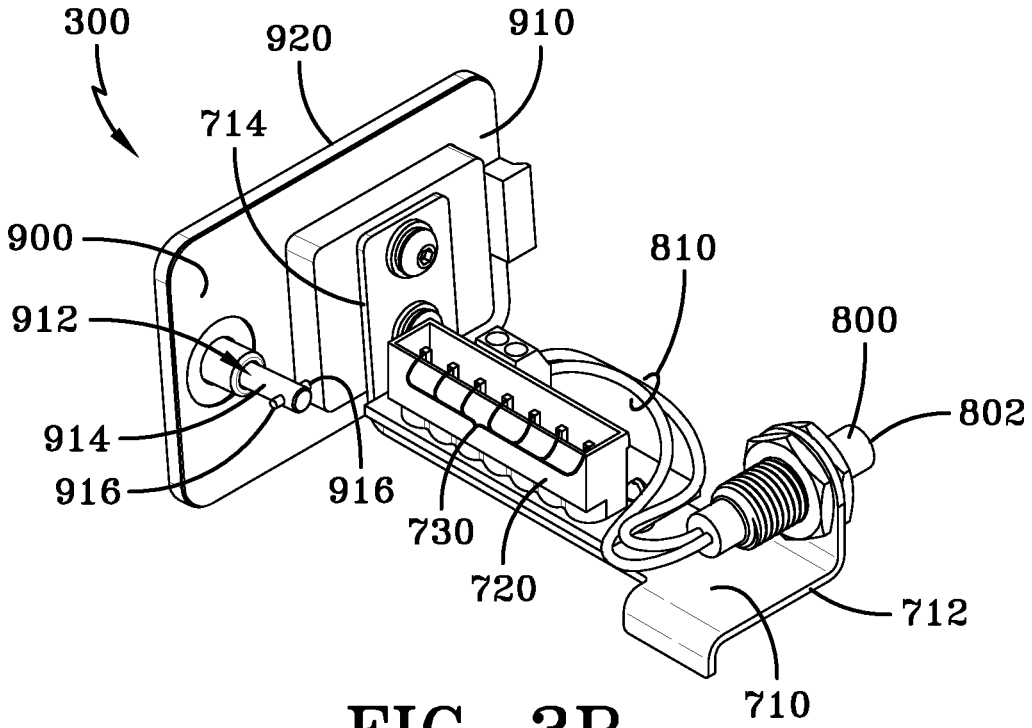
FIG. 3B is perspective view of the detection module in accordance with the concepts of the various embodiments disclosed herein.
Figure 3C:
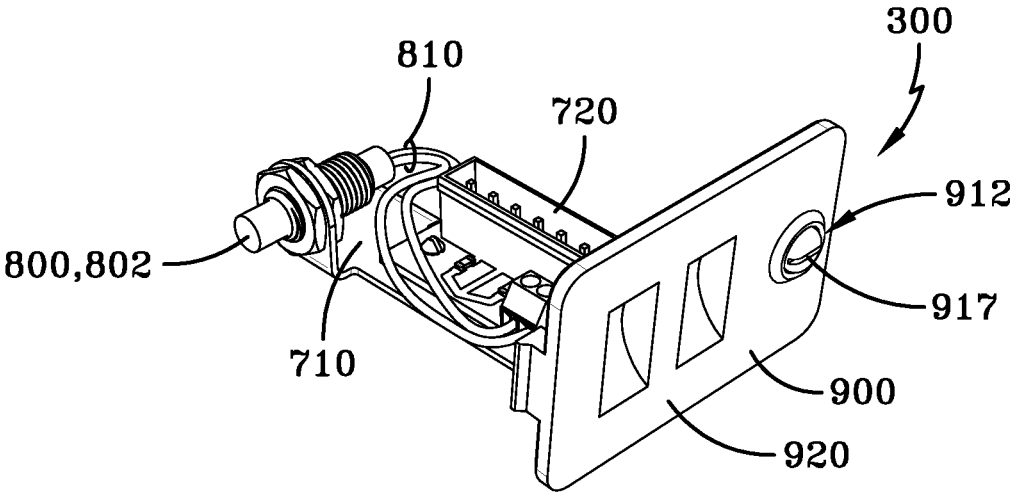
FIG. 3C is another perspective view of the detection module in accordance with the concepts of the various embodiments disclosed herein.

The detection module 300, shown particularly in FIGS. 3A-C, is configured to be inserted through the module aperture 250 in a manner to be discussed. In particular, the detection module 300 includes a bracket or support member 710, which may be formed of any suitable material, such as metal, plastic, composite, polymeric material, and the like. The bracket 710 may be elongated and terminated by ends 712 and 714. The bracket 710 carries a module connector 720 that is compatible with being electrically mated or coupled to the interface connector 600. As such, the module connector 720 may include a plurality of terminals 730 that are configured to be electrically coupled to corresponding terminals 620 provided by the interface connector 600. For example, the module connector 720 may include 7 terminals 730. In other words, the interface connector 600 is configured to be compatibly coupled to the module connector 720 of the detection module 300 so that the power supply line 611 and the antenna position monitor line(s) 620 are electrically coupled to terminals 730 of the detection module 300.

In addition, the detection module 300 includes a sensor 800, such as a position sensor, which is positioned proximate to the end 712 of the bracket 710. However, it should be appreciated that the sensor 800 may be attached at any position relative to the bracket 710. The sensor 800 is attached to the bracket 710 via any suitable means of fixation, such as adhesive, rivets, a threaded connection, or the like, including by way of one or more threaded nuts. The sensor 800 is electrically coupled to the module connector 720 via a suitable coupling interface 810, such as one or more wires or a printed circuit board (PCB) for example. In some embodiments, the sensor 800 may comprise a photodetector, a hall sensor, any magnetic or optic sensor, or the like that is capable of detecting or reading a rotational position of the encoder 430 that is carried by the shaft 410 of the motor drive 400. In addition, the sensor 800 may be positioned relative to the longitudinal axis of the bracket 710 at a substantially right angle thereto. Thus, when the interface connector 600 is electrically coupled to the module connector 720, the power supply line 611 and the antenna position monitor line 620 are placed in electrical communication with the sensor 800 to enable the sensor 800 to operate and monitor the rotational position of the encoder 310 as it is moved by the motor shaft 410.

It should be appreciated that in some embodiments, when the detection module 300 is attached to the housing 110, the sensor 800 having a face surface 802 may be positioned proximate to a radially-extending face surface of the encoder disk 430, or alternatively, may be positioned so that the face surface 802 of the sensor 800 is positioned proximate to an outer circumferential or peripheral edge or surface 805 of the encoder disk 430, as shown in FIG. 2B.

Attached to the end 714 of the bracket 710, and in some embodiments at a position that is opposite the sensor 800, is a cover 900. The cover 900 has an opposed inner surface 910 and outer surface 920. As such, the inner surface 910 may be attached to the bracket 710 using any suitable means of attachment, such as rivets, screws, adhesive or the like. The cover 900 is dimensioned to close or cover the module aperture 250. In some embodiments, a seal or gasket 950 may be placed adjacent to the inner surface 910 of the cover 900 to prevent the intrusion of environmental elements, such as rain, snow and the like through the module aperture 250 and into the housing 100 when the detection module 300 is attached thereto. The cover 900 also includes a lock mechanism 912 that is configured to be selectively locked to the lock aperture 610 that is disposed in the housing section 110A. Accordingly, the lock mechanism 912 may be selectively locked and unlocked by a user in a convenient and user-friendly manner. In particular, the lock mechanism 912 may include a shaft 914, which includes one or more barbs 916 at one end, while a keyed depression 917, such as a slot, is provided at another end. As such, the when the shaft 914 is received within the lock aperture 610 and rotated, the barb 916 is selectively captured by an inner surface of the housing section 110A so as to retain or release the detection module 300 relative to the housing section 110A. However, the lock mechanism 912 may include any suitable structure for selectively retaining the detection module 300 to the housing section 110A. It should be appreciated that in some embodiments, the lock mechanism 912 may be carried by other portions of the detection module 300 other than the cover 900. In some embodiments, the lock mechanism may comprise magnets in the cover 900, which are magnetically attached to the housing section 110A, so as to secure the module 300 thereto.

Figure 1B:
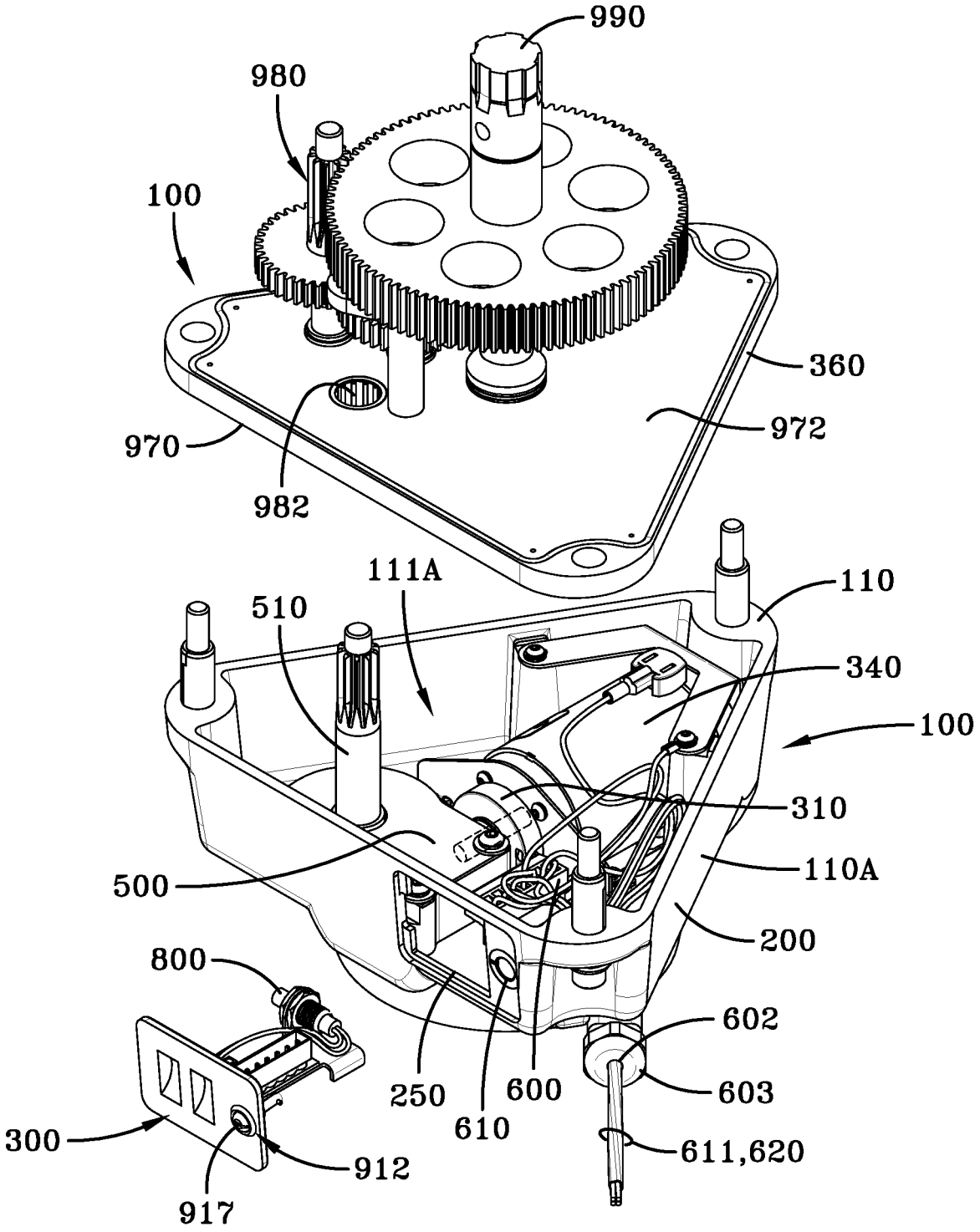
FIG. 1B is an exploded view of the antenna rotator in accordance with the concepts of the various embodiments disclosed herein.

In addition, when the sections 110A and 110B of the rotator 100 are assembled together, the plate 360 is positioned therebetween, as shown in FIG. 1B. The plate 360 includes opposed inner and outer surfaces 970 and 972. The plate 360 may be generally shaped to conform to the shape of the sections 110A and 110B, and may be formed of any suitable material, such as metal or polymeric material for example. A gear assembly 980 is positioned proximate to the outer surface 927 of the plate 360 and includes an aperture 982 through which the shaft 510 is received. As such, the gear assembly 980 is configured to be rotatably driven by the shaft 510 of the transmission 500. In addition, the gear assembly 980 is configured to rotatably move a primary output shaft 990 to which an antenna, antenna mast, or other attachment bracket 992 is attached. As such, the motor drive 340, the transmission 500 and the gear assembly 980 form a motor drive assembly. It should be appreciated that through the use of know techniques, the motor drive 340 may be configured to effectuate the movement of the rotating the shaft 990 with or without one or more of the transmission 500 and gear assembly 980. In other words, the rotator 100 may be configured as a direct drive system in which the shaft 410 of the motor drive 340 is directly attached to an antenna. Thus, a motor drive assembly includes at least the motor drive 340, and optionally in some embodiments, as shown in the FIGS., the transmission 500 and the gear assembly 980.

Thus, to place the rotator 100 into operation, the detection module 300 is inserted into the module aperture 250 so that the sensor 800 and the connector 720 are within the cavity 111A. As a result, the module connector 720 is enabled to be operatively mated with the interface connector 600 within the housing 110A. The lock mechanism 912 is then set by the user to secure the detection module 300 to the housing 110. Thus, when the module connector 720 and the interface connector 600 are mated, the electrical lines 611 and 620 are connected to the coupling interface 810 of the sensor 800. As such, the sensor 800 is made operable.

As such, when the detection module 300 is damaged during operation of the antenna rotator 100, such as through lightning, or through any other event internal or external to the rotator 100, the detection module 300 may be easily and conveniently removed and replaced with a new, operable detection module 300. Such a configuration, results in a savings in time and cost, by allowing a user to easily remove and replace the position detection module 300, while leaving the rotator housing 110 mounted in position. In other words, the rotator housing 110 allows the user to remove only the detection module 300, whereas in conventional rotators, an individual would have to expend substantial time and effort removing the conventional rotator from its existing mount, disassembling it, and then repairing the components embodying the detection module 300 therewithin.

It is also contemplated that in other embodiments the detection module 300 may comprise a module that does not include the sensor 800, but which contains any other desired electrical component(s) for enabling or controlling the operation of the antenna rotator, or providing an additional operating feature for the antenna rotator 100. For example, the module may include the module connector 600, which is configured to communicate with one or more of the lines 611,620.

Therefore, it can be seen that the objects of the various embodiments disclosed herein have been satisfied by the structure and its method for use presented above. While in accordance with the Patent Statutes, only the best mode and preferred embodiments have been presented and described in detail, with it being understood that the embodiments disclosed herein are not limited thereto or thereby. Accordingly, for an appreciation of the true scope and breadth of the embodiments, reference should be made to the following claims.

What is claimed is:

1. An antenna rotator comprising:

a housing having an access port opening;

a motor drive assembly carried in said housing, said motor drive assembly adapted to be coupled to an antenna;

an interface connector carried inside a cavity defined by said housing and positioned proximate to said access port, said interface connector in electrical communication with one or more of a power supply line and a communication line; and a module including an electronic component carried on a bracket that extends from a cover, said cover being removably attached within said access port opening, such that when said cover is attached to said housing, said electronic component is received through said access port opening and into said cavity, wherein said electronic component is removably attached to said interface connector so as to couple one or more of said power supply line and said communication line with said electronic component.

2. The antenna rotator of claim 1, wherein at least a portion of said module extends through said access port opening.

3. The antenna rotator of claim 1, wherein said module includes a cover to seal said access port opening.

4. The antenna rotator of claim 3, wherein said module includes a lock mechanism to selectively secure said module to said housing.

5. The antenna rotator of claim 4, wherein said lock mechanism is receivable in an aperture disposed in said housing to selectively retain said module to said housing.

6. The antenna rotator of claim 5, wherein said lock mechanism is carried by said cover.

7. The antenna rotator of claim 1, wherein said electrical component comprises a position sensor configured to monitor a position of an encoder rotatably carried by a drive shaft of a motor provided by said motor drive assembly.

8. The antenna rotator of claim 7, wherein said encoder is a magnetic encoder disk that is rotatably carried by said drive shaft, wherein said position sensor monitors the position of said magnetic encoder disk to identify a position of said drive shaft of said motor.

9. The antenna rotator of claim 8, wherein said position sensor is positioned to monitor a circumferential edge of said magnetic encoder disk.

10. An antenna rotator comprising:

a housing having an access port opening;

a motor drive assembly carried in said housing, said motor drive assembly adapted to be coupled to an antenna;

an interface connector carried in said housing and positioned proximate to said access port opening, said interface connector in electrical communication with one or more of a power supply line and a communication line; and a module positioned proximate to said access port opening and removably attached to said interface connector so as to couple one or more of said power supply line and said communication line with an electronic component provided by said module, wherein said module includes a lock mechanism to selectively secure said module to said housing.

11. The antenna rotator of claim 10, wherein said module includes a cover to seal said access port opening.

12. The antenna rotator of claim 10, wherein said lock mechanism is receivable in an aperture disposed in said housing to selectively retain said module to said housing.

* * * * *